United States Patent [19]

Barber

[11] 4,362,424

[45] Dec. 7, 1982

[54] SPEED BUMP

[76] Inventor: Gerald L. Barber, 10 Wittington Ct., Greenville, S.C. 29605

[21] Appl. No.: 173,739

[22] Filed: Jul. 30, 1980

[51] Int. Cl.[3] ..... E01F 13/00

[52] U.S. Cl. ..... 404/6; 293/107

[58] Field of Search ..... 404/11, 12, 19, 6, 9, 404/16, 15; 49/49; 293/107

[56] References Cited

U.S. PATENT DOCUMENTS

| | | | |
|---|---|---|---|
| 1,688,409 | 10/1928 | Campbell | 404/12 |
| 1,881,390 | 10/1932 | Schmidt | 293/107 |
| 2,975,350 | 3/1961 | Mahoney | 49/49 |
| 3,503,600 | 3/1970 | Rich | 293/107 |
| 3,514,144 | 3/1970 | Alderfer | 293/107 |
| 4,012,156 | 3/1977 | Turner et al. | 404/15 |
| 4,203,685 | 5/1980 | Sanchez | 404/6 |

FOREIGN PATENT DOCUMENTS

| | | | |
|---|---|---|---|
| 45971 | 1/1939 | Netherlands | 404/11 |

*Primary Examiner*—Nile C. Byers, Jr.

[57] ABSTRACT

A speed bump for use on roadways which imparts a controlled jar to vehicles as they pass thereover. A retarding force is imparted to a downwardly depressible member responsive to the speed of the vehicle.

4 Claims, 8 Drawing Figures

SPEED BUMP

BACKGROUND OF THE INVENTION

Heretofore speed bumps have been installed on roads particularly in congested areas where it is desired that the vehicles travel at a relatively slow speed. These speed bumps are often installed in large parking lots, school zone, apartment building complexes, etc.

One problem with such speed bumps is that they are normally constructed of asphalt and project above the road surface approximately six to eight inches. In order to pass over these speed bumps without imparting substantial jar to the vehicle, the speed of the vehicle must be reduced to approximately five miles an hour in some instances. Even when the speed of the vehicle has been reduced, a substantial jar is often imparted to the vehicle and in some cases the speed bump strikes the frame of the vehicle.

In order to overcome these undesirable disadvantages attempts have been made to produce retractible safety speed bumps such as disclosed in U.S. Pat. No. 4,012,157. Such a speed bump is provided to be nested into a recess when not in use. Another removable speed bump is disclosed in U.S. Pat. No. 1,688,409. In this particular device the speed bump is pivoted out of the path of the vehicles when not in use.

SUMMARY OF THE INVENTION

The speed bump constructed in accordance to the present invention is provided for imparting a controlled bump to a vehicle as the tires of the vehicle passes thereover. The degree of jar imparted to the vehicle as the vehicle passes thereover depends on the speed of the vehicle.

The speed bump constructed in accordance with the present invention includes an elongated flexible housing which has a length sufficient to extend across a portion of the road for covering the path traveled by the vehicles. An elongated sealed chamber is carried in the housing and fluid is provided in the sealed chamber.

The elongated flexible housing is secured by any suitable means such as spikes passing through flanges provided thereon into the road bed. The elongated housing projects vertically above the road and is compressed by the tire of the vehicle as the tire passes thereover displacing the fluid under the tire within the chamber. Various means are provided for restricting displacement of the fluid within the chamber at a controlled rate so that if the vehicle is traveling at a very slow speed the bump is compressed minimizing the jar wherein if the vehicle is traveling at a higher undesirable speed there is insufficient time for the bump to collapse thereby imparting a substantial jar to the vehicle.

In one particular embodiment the means for retarding the displacement of the fluid within the elongated chamber includes an elongated plate which divides the housing into an upper and lower chamber. The fluid is normally contained in the lower chamber and the plate has passages provided therein which allow the fluid to flow through the passages into on upper chamber responsive to the pressure of the tire bearing down on a portion of the housing. The number and the size of the holes in the plate control the retarding force imparted by the fluid.

In another embodimemt a conduit extends from one end of the elongated flexible housing to the bottom of a vertically extending cylinder. Provided within the cylinder is a displacable piston. As the tire strikes the flexible housing, the piston is raised producing a retarding force.

In still another embodiment the retarding force is produced by the flexibility of a cylinder in which the fluid is carried.

Accordingly it is an important object of the present invention to provide a speed bump wherein the jolt imparted to the vehicle that passes thereover varies according to the speed that the vehicle is traveling.

Still another important object of the present invention is to provide a speed bump which includes an elongated flexible housing compressible to minimize the jolt imparted to a vehicle traveling at the desired speed as it passes thereover.

Other objects and advantages of this invention will become more apparent from reading the following detailed description and appended claims taken in conjunction with the accompanying drawings wherein:

DESCRIPTION OF THE PREFERRED EMBODIMENT

Figure 1:
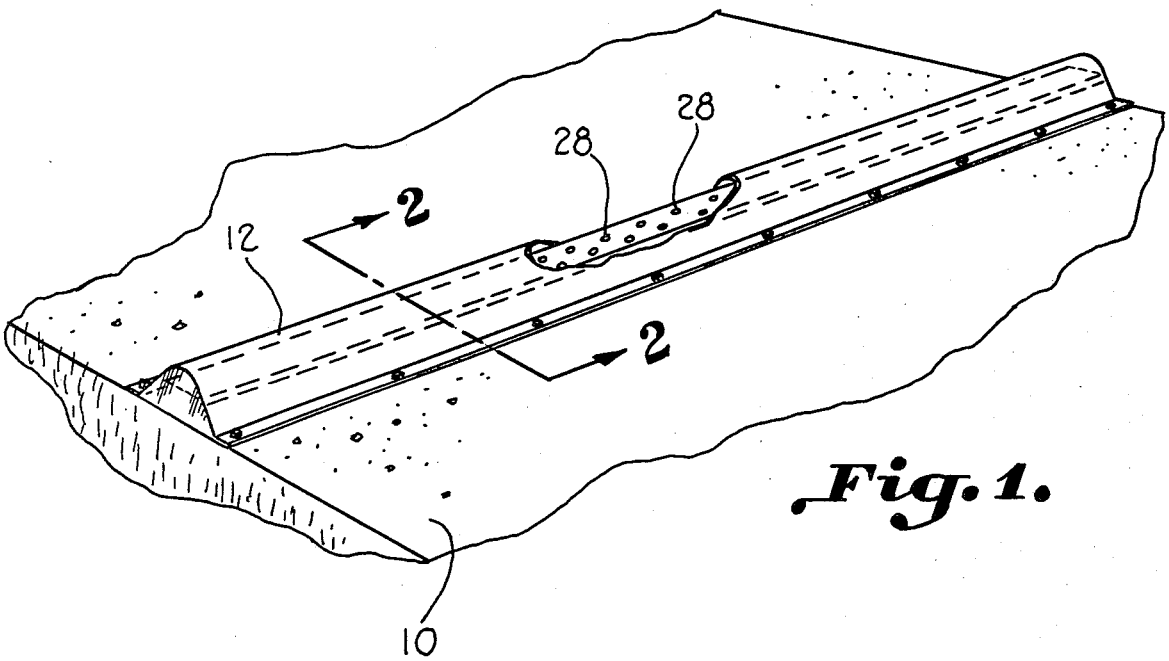
FIG. 1 is a perspective view, with parts broken away, illustrating a speed bump constructed in accordance with the present invention.

Referring in more detail to FIG. 1 of the drawings, there is illustrated a speed bump for use on a road 10 for imparting a controlled impact to a vehicle as the tires of the vehicle pass thereover. The bump includes an elongated flexible housing 12 constructed of any suitable hard rubber material and has a substantially triangular upper portion with a rounded top 14 and a horizontal base 16 producing an elongated sealed chamber. Opposed flanges 18 and 20 are integral with the inner walls and have grooves provided therein for receiving downwardly turned flange portions 22 and 24 of an elongated horizontally extending plate 26. The plate has longitudinally spaced holes 28 provided therein. The plate divides the interior of housing into a lower chamber 30 and an upper chamber 32. Communication between the lower chamber 30 and the upper chamber 32 is through the openings 28 provided in the plate 26.

Outwardly extending flanges 34 and 36 are provided adjacent the bottom of the housing through which fastening devices such as bolts 38 can pass for securing the bump to the road.

In operation as a vehicle passes over the bump, the tire 40 rolls over the top portion 14 of the bump, depressing the bump. The increased pressure build-up on the fluid directly below the tire causes the fluid 42 to be forced upward through the openings 28 from the lower chamber 30 into the upper chamber 32. The number of openings 28 and the size of the openings control the retarding force imparted by the fluid.

As a result if the automobile is travelling at the desired rate of speed, say five miles per hour, there will be sufficient time for the bump to be compressed. However, if the vehicle is travelling at an excessive rate of speed, for the particular road then upon striking the bump, the bump will not be compressed entirely and a very unpleasant and sudden shock will be imparted to the vehicle. In other words the bump produces a shock having an intensity which varies according to the speed of the vehicle.

Figure 2:
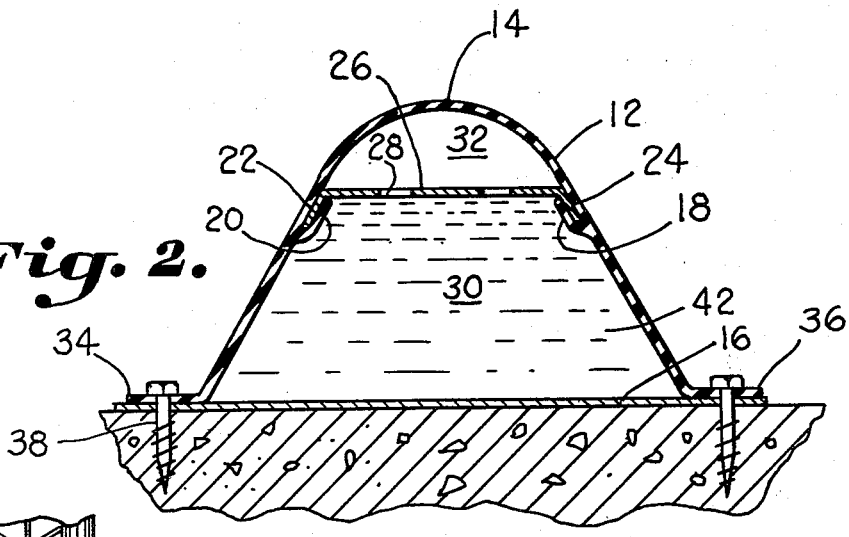
FIG. 2 is a sectional view taken along line 2—2 of FIG. 1.
Figure 3:
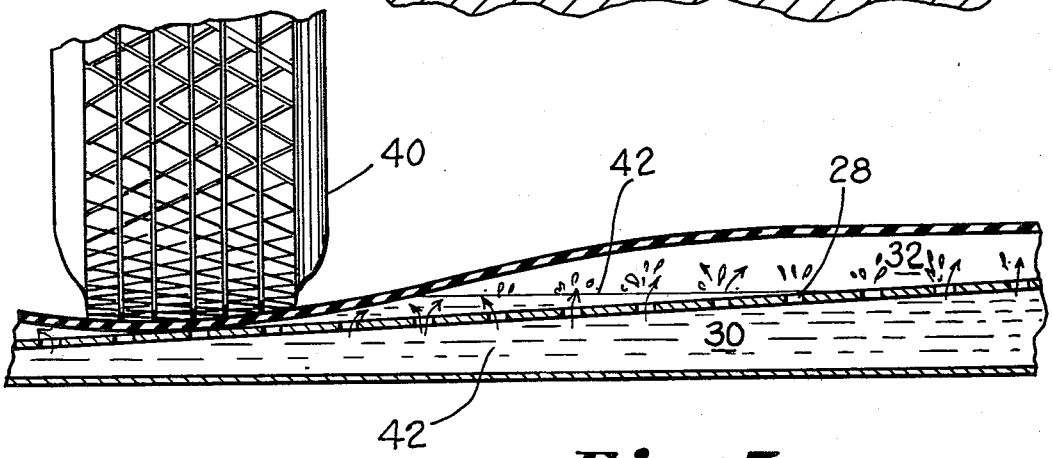
FIG. 3 is a longitudinal sectional view illustrating a tire of a vehicle compressing the elongated tube as it passes thereover.
Figure 4:
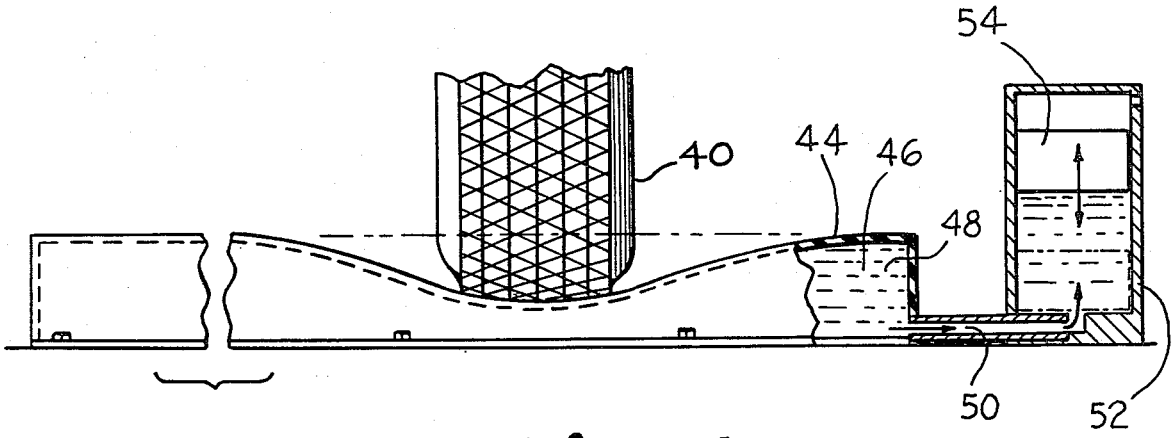
FIG. 4 is a side elevational view of a modified form of the invention.

In FIG. 4 there is illustrated a modified form of the invention wherein the elongated housing 44 constructed in the same manner as the housing shown in FIGS. 1 and 2 is provided for extending across the path of travel of vehicles on the road. The only difference is that there is a single inner chamber 46 that is filled with fluid 48. Adjacent the right end of the chamber 46 is a conduit 50 that extends to the bottom of the vertically extending cylinder 52. Positioned in the cylinder 52 is a weighted piston 54. As the tire of the vehicle passes over the housing 44 it compresses the housing forcing the fluid through conduit 50 causing the piston 54 to be raised. The retarding force on the fluid can be varied by varying the weight of the piston 54.

Figure 5:
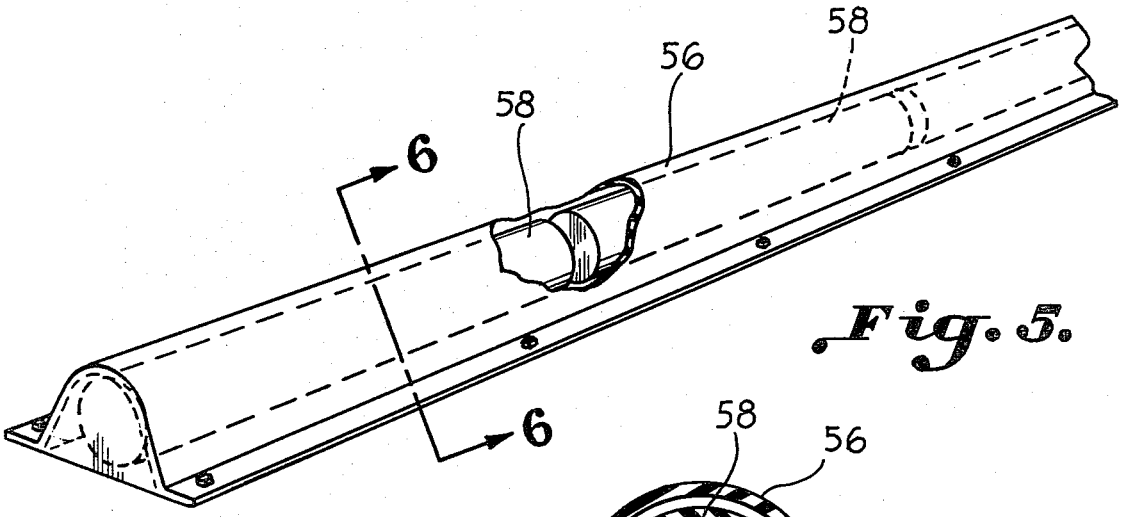
FIG. 5 is a perspective view, with parts broken away for purposes of clarity, illustrating still another modified form of the invention.
Figure 6:
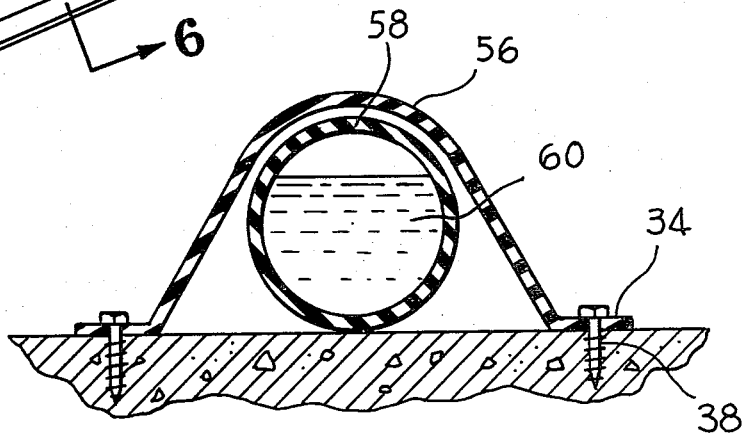
FIG. 6 is a sectional view taken along line 6—6 of FIG. 5.

In FIG. 5 there is illustrated still another modified form of the invention. An elongated flexible housing 56 is constructed in the same manner as the housing 12 with the exception that it is hollow throughout. Positioned within the hollow chamber are a plurality of longitudinally spaced cylinders 58 that are partially filled with fluid 60. By using a plurality of cylinders instead of a single chamber, the bump can be positioned on an inclined road surface without the fluid flowing completely to the lower end thereof.

As a vehicle's tire passes over the bump 56 it causes the housing and the cylinder 58 positioned directly therebelow to be compressed. The cylinder 58 may be constructed of any suitable flexible material so that when pressure is imparted by the tire over one point it will deform within the housing 56. Any suitable fluid can be utilized within the cylinders as long as it does not freeze. It should have a freezing point much lower than the lowest temperature that would be incurred during wintertime in the area.

The degree of shock imparted by the speed bump can be varied by varying the ratio of fluid and water within the cylinder 58.

For example if a substantial amount of water is provided in the cylinder, the shock is less severe than when the cylinder is completely full with fluid. When the cylinder is completely full of fluid, the fluid causes the walls of the cylinder to expand as the tire rolls over the bump. Whereas when there is a substantial amount of air in the cylinder the air within the cylinder is compressed and the flexibility of the wall of the cylinder 58 has less effect.

Figure 7:
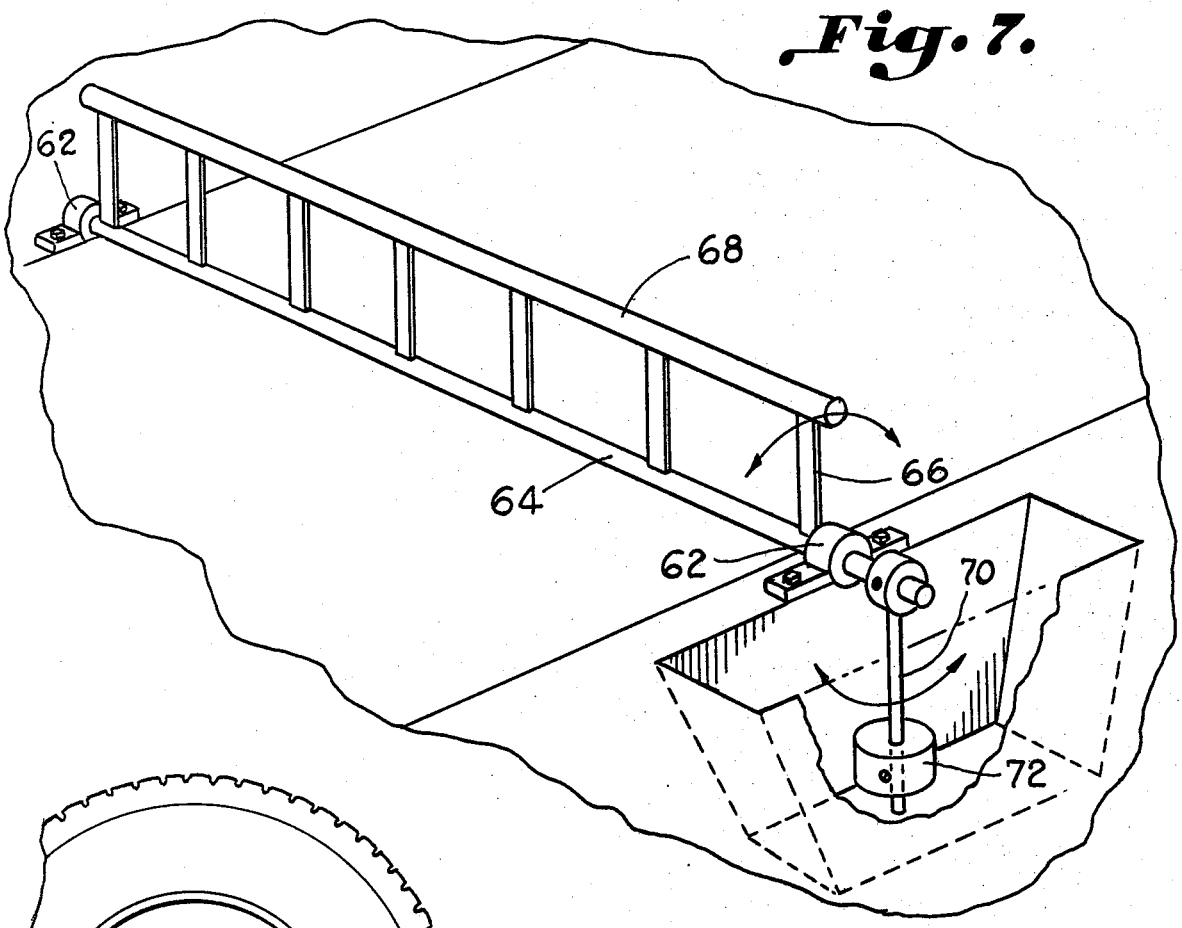
FIG. 7 is a side view of still another modified form of the invention.

In FIG. 7 there is illustrated still another modified form of the invention wherein a mechanical device is used for providing a bump to tires. The mechanical device includes a pair of bearing blocks 62 which are spaced across the road. The bearing blocks are recessed down below the road bed so that a horizontally extending rod member 64 is located substantially flush with the upper surface of the road bed. Extending outwardly from the rod 64 are braces 66 which have another rod 68 secured to the outer ends thereof.

The rod-like member 64 extends laterally beyond the bearing post 62 and has a radially extending arm 70 fixed to the end thereof. The arm extends vertically downwardly whereas the braces 66 extend vertically upwardly. Adjustably fixed to the lower end of the arm 70 is a weight 72 which is greater than the weight of the rod 68 and the braces 66 so that the weight maintains the braces 66 extending vertically upwardly.

Depending on the direction that the car strikes the upper rail 68 the rail will pivot from a vertical position to a horizontal position. If the car strikes the rail at a slow speed the retaining force imparted by the counter weight 72 is overcome at a slower rate, minimizing the shock imparted by the rail 68 striking the tire. However, if the vehicle strikes at an excessive rate of speed a sudden jar will be imparted through the tires to the vehicle as a result of the retarding force imparted by the counter weight 72.

Figure 8:
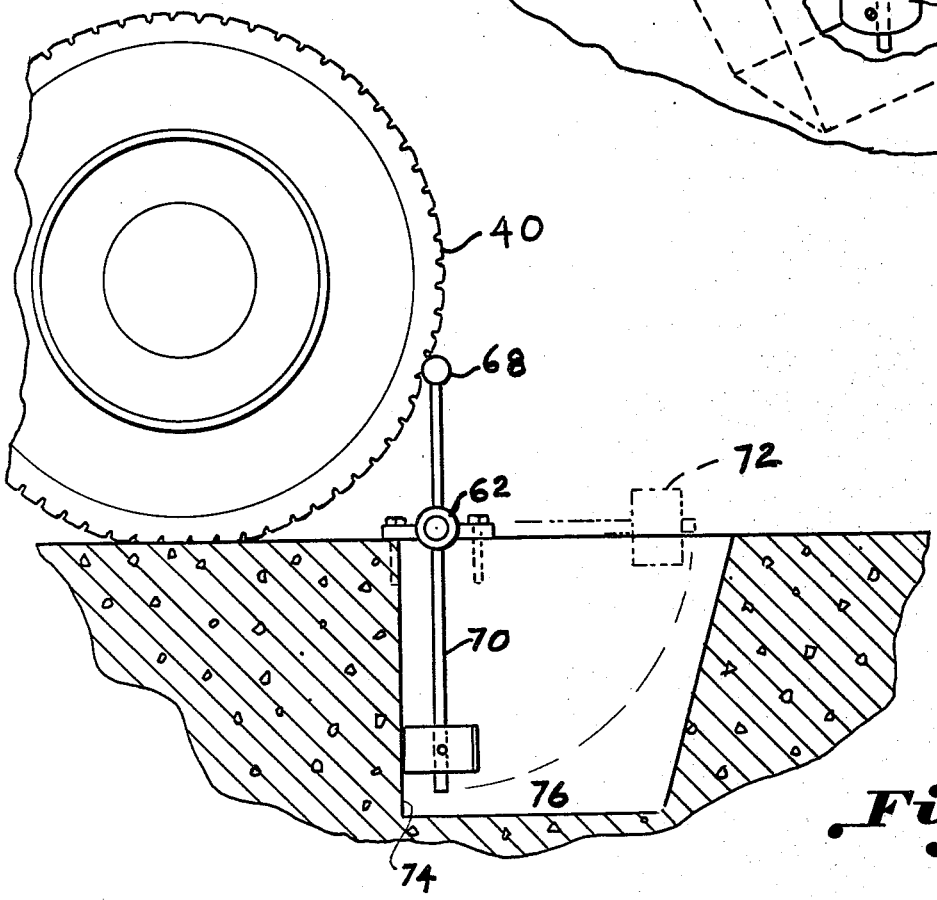
FIG. 8 is a side elevational view of still another modified form of the invention.

In FIG. 8 of the drawings there is illustrated still another modified form of the invention wherein instead of the rail 68 being able to pivot in either direction for imparting a controlled jar to cars traveling in both directions on a road it can pivot in only one direction. In some instances it is desired to use the bump to act as more or less a barrier against travel in one direction while permitting free travel in the other direction. For example on access roads to superhighways which are normally one way, if the vehicle were traveling as shown in FIG. 8 from left to right the weight would strike a vertical wall 74 of the recess chamber 76. As a result the rail 68 would remain in the vertical position shown. This would prevent people from inadvertently getting on superhighways going in the wrong direction.

If the car was traveling from right to left as shown in FIG. 8 then the barrier would operate in the same manner as discussed in connection with FIG. 7.

While a preferred embodiment of the invention has been described using specific terms, such description is for illustrative purposes only, and it is to be understood that changes and variations may be made without departing from the spirit or scope of the following claims.

What is claimed is:

1. A speed bump for use on a road for imparting a controlled jar to a vehicle as the tires of said vehicle pass thereover comprising:

an elongated flexible housing having a length sufficient to extend across a portion of a road to cover a path traveled by vehicles;

an elongated chamber carried in said housing;

fluid carried in said elongated chamber;

means for securing said elongated flexible housing to said road;

said elongated housing projecting vertically above said road and being compressible by a tire of said vehicle as said tire passes thereover for displacing said fluid under said tire from said chamber; and means for retarding the displacement of said fluid from said chamber and the compression of said housing at a controlled rate as said tire of said vehicle passes over said elongated flexible housing.

2. The speed bump as set forth in claim 1 further comprising:

said means for retarding the displacement of said fluid including:

an elongated plate carried within said elongated flexible housing dividing said elongated chamber into an upper and lower chamber;

said fluid being carried in said lower chamber and air is provided in said upper chamber;

openings provided in said elongated plate for permitting said fluid in said lower chamber to flow into said upper chamber at a controlled rate responsive to the pressure of the tire of the vehicle engaging said elongated flexible housing for controlling the compression of said housing.

3. The speed bump as set forth in claim 1 further comprising:

said means for securing said elongated flexible housing to said road including:

(i) opposed outwardly extending flanges provided adjacent a lower portion of said housing; and (ii) fastening means extending through said flanges securing said housing to said road.

4. The apparatus as set forth in claim 1 further comprising:

said means for retarding the displacement of said fluid including:

(i) a vertically extending housing;

(ii) conduit communicating between said elongated flexible housing and said vertically extending housing; and (iii) a piston provided in said vertically extending housing which is raised responsive to fluid being forced from said elongated flexible housing into said vertical housing.

* * * * *